US009738103B2

(12) United States Patent
Kato

(10) Patent No.: US 9,738,103 B2
(45) Date of Patent: Aug. 22, 2017

(54) POST-PROCESSING APPARATUS, IMAGE FORMING SYSTEM, AND POST-PROCESSING METHOD

(71) Applicant: KONICA MINOLTA INC., Chiyoda-ku, Tokyo (JP)

(72) Inventor: Norishige Kato, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 229 days.

(21) Appl. No.: 14/558,293

(22) Filed: Dec. 2, 2014

(65) Prior Publication Data

US 2015/0158322 A1 Jun. 11, 2015

(30) Foreign Application Priority Data

Dec. 10, 2013 (JP) ..... 2013-254909

(51) Int. Cl.
*B42C 11/02* (2006.01)
*B41J 29/38* (2006.01)
(Continued)

(52) U.S. Cl.
CPC ..... *B42C 11/04* (2013.01); *B42C 9/0025* (2013.01); *B42C 19/02* (2013.01)

(58) Field of Classification Search
CPC ..... B42C 9/0012; B42C 9/005; B42C 9/0037; B42C 11/02; G03G 15/6541; G03G 15/6544
See application file for complete search history.

(56) References Cited

U.S. PATENT DOCUMENTS 6,364,590 B1 * 4/2002 Gayoso ..... B42C 7/005 270/52.08
7,722,023 B2 5/2010 Hattori
(Continued)

FOREIGN PATENT DOCUMENTS

JP 2005059253 A * 3/2005 ..... B42C 11/02
JP 2008272962 A 11/2008
(Continued)

OTHER PUBLICATIONS

Japanese Office Action (and English translation thereof) dated Oct. 14, 2015, issued in counterpart Japanese Application No. 2013-254909.

*Primary Examiner* — Blake A Tankersley
*Assistant Examiner* — Ruben Parco, Jr.
(74) *Attorney, Agent, or Firm* — Holtz, Holtz & Volek PC

(57) ABSTRACT

A post-processing apparatus for performing post-processing on a sheet having an image formed thereon, the post-processing at least including case bookbinding by using paste, the apparatus including: a paste applicator having a paste application member and configured to supply paste to coat a back of a sheet bundle with the paste; a pressurization member for pressing a cover onto the back of the sheet bundle with the paste coated thereon; and a controller configured to receive information relating to a cover gutter setting on the sheet bundle and to perform control over the paste applicator and the pressurization member, the controller being configured to cause, in a guttered cover setting, the paste to overflow in a larger amount from the back of the sheet bundle toward a gutter than an amount of overflow in a non-guttered cover setting based on the information relating to the cover gutter setting.

18 Claims, 11 Drawing Sheets

(51) Int. Cl.

| | |
|---|---|
| ***B42C 11/04*** | (2006.01) |
| ***B42C 19/02*** | (2006.01) |
| ***B42C 9/00*** | (2006.01) |

(56) References Cited

U.S. PATENT DOCUMENTS

| | | | | |
|---|---|---|---|---|
| 8,331,846 | B2 | 12/2012 | Kato | |
| 2010/0278618 | A1* | 11/2010 | Hata | B26F 1/12 412/37 |
| 2013/0259607 | A1* | 10/2013 | Nakanishi | B42C 11/04 412/19 |

FOREIGN PATENT DOCUMENTS

| | | | | | |
|---|---|---|---|---|---|
| JP | 2009078424 | A | | 4/2009 | |
| JP | 2009285923 | A | | 12/2009 | |
| JP | 2011000773 | A | | 1/2011 | |
| JP | 2011183634 | A | | 9/2011 | |
| JP | 2011219231 | A | * | 11/2011 | B65H 37/04 |
| JP | 2012006699 | A | * | 1/2012 | B65H 37/02 |
| WO | 2013031014 | A1 | | 3/2013 | |

* cited by examiner

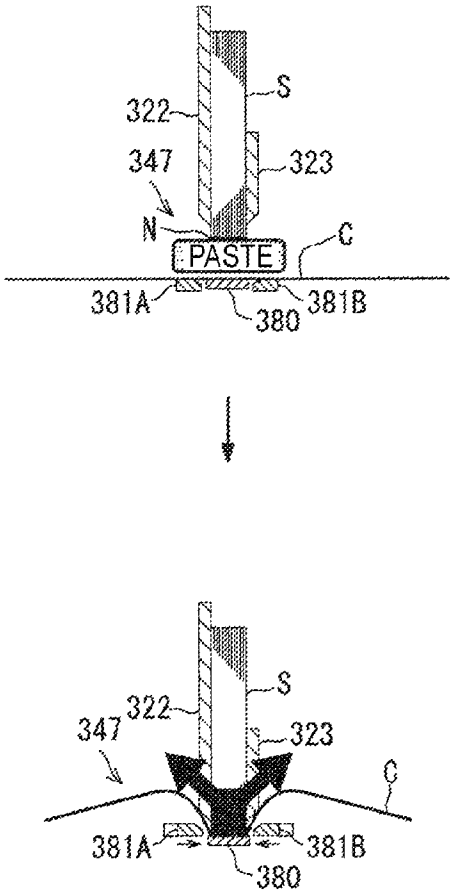
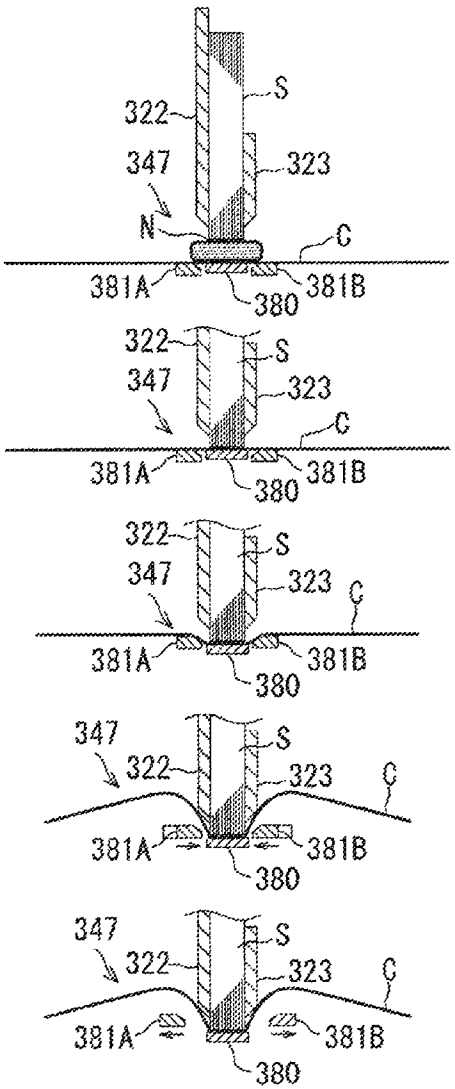
FIG. 8A
FIG. 8B
FIG. 8C
FIG. 8D
FIG. 8E

POST-PROCESSING APPARATUS, IMAGE FORMING SYSTEM, AND POST-PROCESSING METHOD

The entire disclosure of Japanese Patent Application No. 2013-254909 filed on Dec. 10, 2013 including description, claims, drawings, and abstract are incorporated herein by reference in its entirety.

BACKGROUND OF THE INVENTION

Field of the Invention

Embodiments of the present invention relate to post-processing apparatuses, image forming systems, and post-processing methods that enable case bookbinding.

Description of the Related Art

Where a case work is created with sheets having images formed thereon, bookbinding is performed such that paste is applied along the back portion of a book body and a cover is adhesively bonded thereto. In applying paste, the paste is preferably applied plentifully in terms of increasing durability and preventing missing of leaves due to pulling off. As depicted in FIG. 14, however, plentiful application of paste causes a considerable amount of paste overflow at a side portion of a booklet S, and the overflow of paste G is visible when a cover C is opened, degrading the quality of the booklet. Hence, the amount of application of paste is suppressed, such that the paste G does not overflow onto the booklet S while durability of the booklet is maintained.

For example, the following techniques are known for optimizing the amount of application of paste.

According to JP 2011-000773 A, an apparatus is disclosed which has information on an optimal amount of paste to be applied per medium and is configured to apply paste according to the paste amount in the information.

According to JP 2009-285923 A, a bookbinding apparatus is disclosed which is configured to increase the amount of application of paste in applying paste to a booklet treated with roughening, so as to increase binding strength.

According to JP 2009-078424 A, a bookbinding apparatus is disclosed which is configured to adjust the coating thickness of a paste layer on the basis of the thickness of a sheet bundle, based on information on a booklet including information about the paper thickness of sheets comprising the sheet bundle, paper size information, weight information, and sheet type information.

In case of case bookbinding, however, the cover sometimes has a gutter (in the vicinity of the bound portion where the booklet is in a spread state). In such a case, the quality is not degraded as depicted in FIG. 14 when the cover is opened, even if the paste overflows toward a side of the booklet S. Rather, no paste overflow toward a side degrades the quality, since the guttered portion easily peels off.

SUMMARY OF THE INVENTION

Embodiments of the present invention are made in view of the foregoing circumstances, and an object of the present invention is to provide a post-processing apparatus, an image forming system, and a post-processing method that allow for increase in durability of the booklet and improvement in quality at the same time by increasing the amount of overflow of paste toward a side in case of a guttered cover.

To achieve at least one of the above-mentioned objects, according to an aspect, a post-processing apparatus configured to perform post-processing on a sheet having an image formed thereon, the post-processing at least including case bookbinding by using paste, the apparatus reflecting one aspect of the present invention comprises: a paste applicator having a paste application member and configured to supply paste to coat a back of a sheet bundle with the paste; a pressurization member configured to press a cover onto the back of the sheet bundle with the paste coated thereon; and a controller configured to receive information relating to a cover gutter setting on the sheet bundle and to perform control over the paste applicator and the pressurization member, the controller being configured to cause, in a guttered cover setting, the paste to overflow in a larger amount from the back of the sheet bundle toward a gutter than an amount of overflow in a non-guttered cover setting based on the information relating to the cover gutter setting.

According to the post-processing apparatus of Item. 2, in Item. 1, the controller is preferably configured to increase an amount of application of the paste to be applied to the sheet bundle by way of the paste applicator in the guttered cover setting.

According to the post-processing apparatus of Item. 3, in Item. 1 or 2, the controller is preferably configured to increase an amount of the paste to move toward the gutter by way of the pressurization member, the paste being placed between the back of the sheet bundle and the cover, in the guttered cover setting.

According to the post-processing apparatus of Item. 4, in any of Items. 1 to 3, the information relating to the cover gutter setting preferably contains information on a depth of the gutter, and the controller is preferably configured to set the amount of overflow according to the depth of the gutter.

According to the post-processing apparatus of Item. 5, in any of Items. 1 to 4, the information relating to the cover gutter setting preferably contains information relating to whether the gutter is set on each of two sides or on one side of the sheet bundle, and the controller is preferably configured to, where the gutters are set on the two sides of the sheet bundle, set different amounts of overflow with respect to each gutter.

According to the post-processing apparatus of Item. 6, in Item. 5, the controller is preferably configured to, where the gutters on the two sides have different depths, set the amounts of overflow with respect to the gutters on the two sides according to the depth of each gutter.

According to the post-processing apparatus of Item. 7, in any of Items. 1 to 4, the controller is preferably configured to, where the gutters on the two sides have different depths in the sheet bundle, decide the amounts of overflow at the gutters on the two sides with reference to the gutter of a smaller depth.

According to the post-processing apparatus of Item. 8, in any of Items. 1 to 3, the controller is preferably configured to, where the gutter is provided on one side of the sheet bundle, skip an operation of increasing the amount of overflow of the paste from the back of the sheet bundle toward the gutter as compared to the amount of overflow in the non-guttered cover setting.

According to the post-processing apparatus of Item. 9, in any of Items. 1 to 7, the paste applicator preferably has an application member inclining mechanism configured to change an inclination angle of the paste applicator in a direction of back width with respect to the back in performing the application, and the controller is preferably configured to adjust the inclination angle of the application member inclining mechanism to adjust the amounts of overflow with respect to the gutters on the two sides of the sheet bundle, or to adjust the amount of overflow toward the gutter where the gutter is provided on one side.

According to the post-processing apparatus of Item. 10, in any of Items. 1 to 9, the controller is preferably configured to increase a drive amount for supplying the paste for the paste application member as compared to that in the case of a non-covered gutter to increase the amount of application of the paste to the back.

According to the post-processing apparatus of Item. 11, in any of Items. 1 to 10, the paste applicator preferably includes a moving mechanism wherein at least the paste application member is configured to relatively move in a lengthwise direction of the back of the sheet bundle to perform application of the paste, and the controller is preferably configured to, in the guttered cover setting, increase the amount of application of the paste to the back by increasing the number of movement or decreasing a moving speed of the moving mechanism in the lengthwise direction or both.

According to the post-processing apparatus of Item. 12, in any of Items. 1 to 11, the paste applicator preferably includes a smoothing member and a smoothing member distance adjusting mechanism, the smoothing member being configured to approach the back applied with the paste to smooth out the paste applied, the smoothing member distance adjusting mechanism being configured to adjust a distance of the smoothing member to the back, and the controller is preferably configured to, in the guttered cover setting, adjust an amount of distance adjustment by the smoothing member distance adjusting mechanism to increase the amount of application of the paste to the back.

According to the post-processing apparatus of Item. 13, in any of Items. 1 to 12, the controller is preferably configured to, in the guttered cover setting, change a position at which the pressurization member stops pressurization with respect to the back from a position at which the pressurization is stopped in the non-guttered cover setting to perform control for adjustment of the amount of overflow to the gutter.

According to the post-processing apparatus of Item. 14, in any of Items. 1 to 13, the apparatus preferably includes a back width direction stopping position changing mechanism configured to change a position at which the pressurization member is stopped in the direction of back width with respect to the back of the sheet bundle, and the controller is preferably configured to, in the guttered cover setting, adjust the back width direction stopping position changing mechanism to perform control for adjusting the amounts of overflow to the gutters on the two sides of the sheet bundle or the amount of overflow toward the gutter where the gutter is provided on one side.

According to the post-processing apparatus of Item. 15, in any of Items. 1 to 14, the post-processing apparatus preferably further comprises a creaser configured to crease the sheet prior to case bookbinding.

According to the post-processing apparatus of Item. 16, in Item. 15, the creaser is preferably configured to crease the sheet at least in line with the gutter.

According to the post-processing apparatus of Item. 17, in Item. 15 or 16, the information relating to the cover gutter setting preferably contains information as to whether a crease other than a crease for a square back of the sheet bundle is provided, and the controller is preferably configured to determine presence of the guttered cover setting based on presence of the crease other than the crease for the square back of the sheet bundle, and to determine absence of the guttered cover setting based on absence of the crease other than the crease for the square back of the sheet bundle.

To achieve at least one of the above-mentioned objects, according to an aspect, an image forming system reflecting one aspect of the present invention comprises: an image forming apparatus configured to form an image on a sheet; and the post-processing apparatus of any of Items. 1 to 17.

To achieve at least one of the above-mentioned objects, according to an aspect, a method of post-processing for performing case bookbinding by using paste, wherein a guttered cover setting or a non-guttered cover setting is selectable, the method reflecting one aspect of the present invention comprises: setting an increased amount of overflow of the paste from a back of a sheet bundle toward a gutter in the guttered cover setting as compared to the amount of overflow for a non-guttered cover; applying the paste to the back based on the setting; and bringing a cover into pressing contact with the back upon application of the paste to make the paste overflow toward the gutter, such that case bookbinding of the sheet bundle with the cover is performed by using the back of the sheet bundle and the gutter.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein:

FIGS. 8A to 8E are process diagrams of joining a cover and forming a square back with the image forming system;

DESCRIPTION OF THE PREFERRED EMBODIMENTS

Hereinafter, an embodiment of the present invention will be described with reference to the drawings. However, the scope of the invention is not limited to the illustrated examples.

One embodiment of the present invention is described below with reference to the accompanying drawings.

Figure 1:
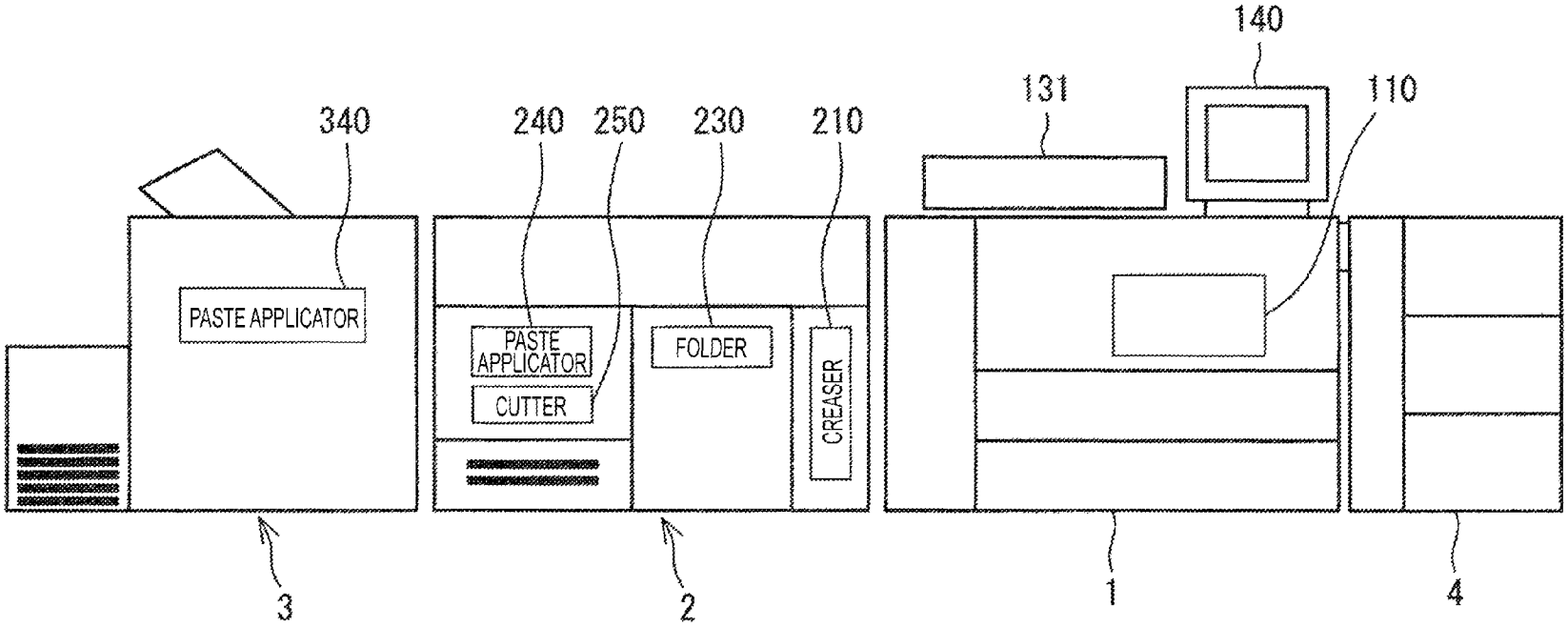
FIG. 1 is a schematic diagram of an image forming system according to one embodiment of the present invention.

FIG. 1 depicts an image forming system according to one embodiment of the present invention. The image forming system includes a second post-processing apparatus as an embodiment of a post-processing apparatus of the present invention.

The image forming system includes an image forming apparatus 1. The image forming apparatus 1 is connected with a large-capacity paper feed tray 4. A first post-processing apparatus 2 is connected with the image forming apparatus 1 at the sheet discharge side. A second post-processing apparatus 3 is connected with the first post-processing apparatus 2 at the sheet discharge side.

The image forming apparatus 1 has, inside the main body of the apparatus, an image former 110 that is configured to form images on sheets. The image forming apparatus 1 has, at an upper portion of the main body of the apparatus, an operation display 140 that is configured to display information in response to an operation by an operator. The operation display 140 may be configured such that an operation part for accepting operations and a display for performing display are provided as discrete units. Alternatively, the operation part and the display may be integrally configured such as a touch panel liquid crystal display (LCD).

Further, an automatic document feeder (ADF) 131 that is configured to read documents automatically is disposed on the main body of the apparatus of the image forming apparatus 1. Images on documents are read by a document reader 130 which is not depicted in FIG. 1, so as to be used in image forming by the image former 110.

The first post-processing apparatus 2 has a function of saddle stitching; in that sense, the first post-processing apparatus 2 is a saddle stitcher. The first post-processing apparatus 2 includes, for example, a creaser 210 that is configured to crease sheets, a folder 230 that is configured to fold sheets, a binder 240 that is configured to bind sheets by using, for example, staples, and a cutter 250 that is configured to cut the peripheries of booklets bound by the binder 240 to adjust the size.

The second post-processing apparatus 3 has a function of case bookbinding; in that sense, the second post-processing apparatus 3 is a case bookbinder. The second post-processing apparatus 3 includes, for example, a paste applicator 340.

Figure 2:
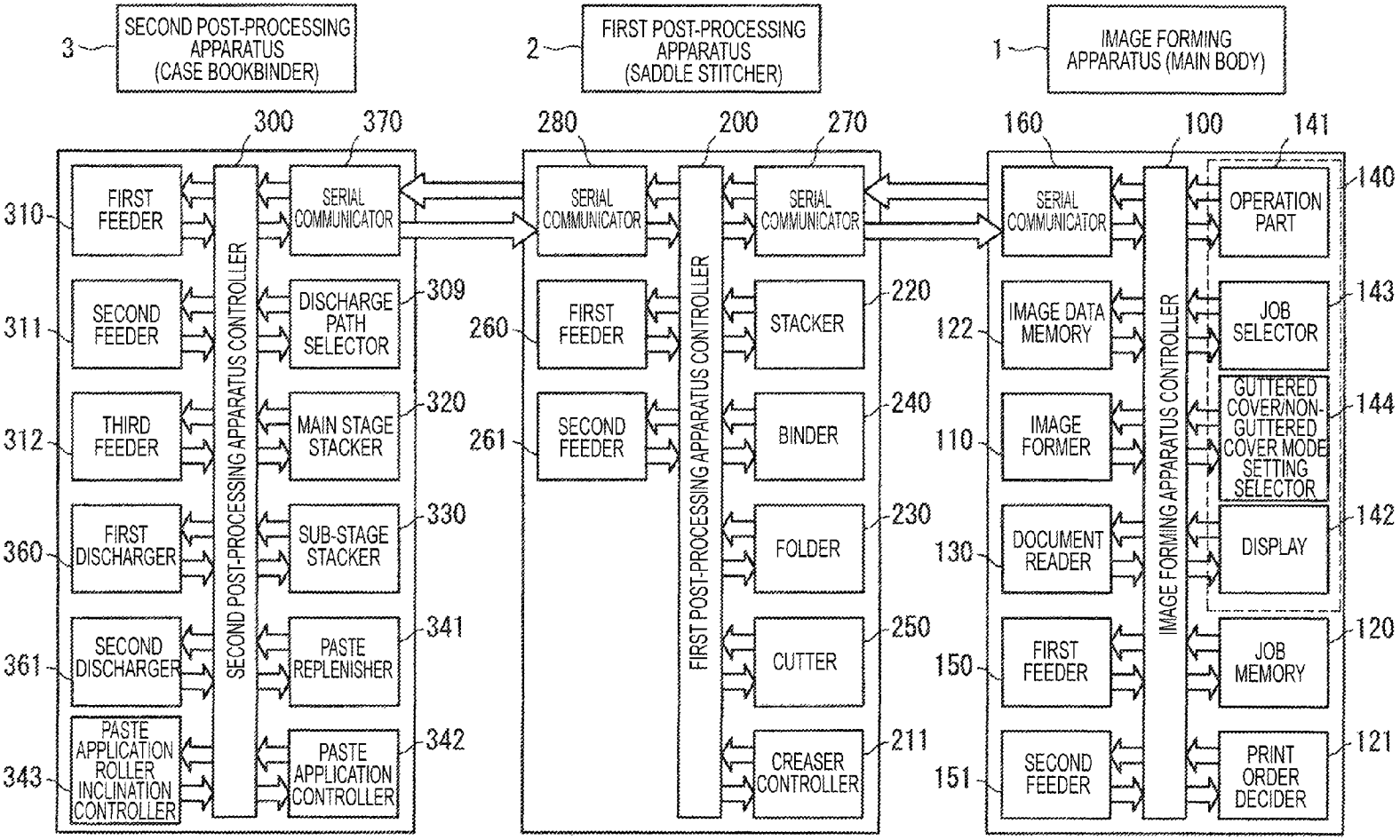
FIG. 2 is a functional block diagram of the image forming system.

Next, functional blocks of the image forming system are described with reference to FIG. 2.

The image forming apparatus 1 has an image forming apparatus controller 100 that is configured to control the entire image forming apparatus and the image forming system. The image forming apparatus controller 100 may be configured by a central processing unit (CPU) and a program for running the CPU, a read-only memory (ROM) for storing, for example, programs, a random access memory (RAM) providing a workspace, and a non-volatile memory for storing, for example, setting data. The image forming apparatus controller 100 corresponds to a controller according to embodiments of the present invention.

The image forming apparatus 1 has the image former 110 that is configured to form images on sheets based on image data and has, for example, a photosensitive body and a charger, a writer, a developer, a transferor, and a fixer. The image forming apparatus controller 100 is controllably connected with a job memory 120, a print order decider 121, and an image data memory 122 comprising, for example, a dynamic random access memory (DRAM).

The image data memory 122 retains, for example, image data that has been read and generated at the document reader 130 to be described later, such that the retained data is read for use at the time of, for example, outputting.

The job memory 120 stores job data containing, for example, print setting including sheet information associated with the image data. Image formation output is performed based on the job data stored on the job memory 120. The job data is generated according to initial setting or setting by the operator upon generation of the image data, and contains post-processing details such as binding processing and case bookbinding. The image former 110 is controlled by the image forming apparatus controller 100. Images are formed on sheets based on the job data and the image data.

The print order decider 121 decides a print order according to priority per job among jobs. The print order may be stored, for example, on the job memory 120.

The image forming apparatus controller 100 is controllably connected with the document reader 130. The document reader 130 is configured by, for example, the automatic document feeder (ADF) 131 and a scanner (not shown). The image data read at the automatic document feeder (ADF) 131 may be stored on the image data memory 122.

The image forming apparatus controller 100 is controllably connected with the operation display 140.

The operation display 140 has an operation part 141 for accepting the operator's operations and a display 142 for displaying information. In this embodiment, the operation part 141 and the display 142 are integrated in the form of a touch panel LCD. The operation display 140 has a job selector 143 that is configured to display, for example, a list of jobs to allow a job to be selected therefrom, so as to issue instructions, for example, to execute the selected job. The operation display 140 also has a guttered cover/non-guttered cover mode setting selector 144 for accepting the operator's selection between a guttered cover and a non-guttered cover. The initial setting may preliminarily include a setting of a guttered cover or a non-guttered cover.

The image forming apparatus controller 100 is controllably connected with a first feeder 150 and a second feeder 151. The first feeder 150 is a unit that is configured to feed sheets sent from a paper feed tray in the image forming apparatus 1 and from the large-capacity paper feed tray 4 to convey the sheets to the first post-processing apparatus 2 on the downstream side following the image information. The second feeder 151 is a unit that branches from the first feeder 150 and is configured to flip the sheets on which images are formed at the image former 110 and to further convey the sheets such that the sheets return to the upstream side of the image former 110.

The image forming apparatus controller 100 is controllably connected with a serial communicator 160. The serial communicator 160 is configured to perform serial communication with a serial communicator 270 included in the first post-processing apparatus 2. The serial communicator 160 is operable to send control commands from the image forming apparatus controller 100 and information from the image forming apparatus 1 to the first post-processing apparatus 2 through the serial communicator 270. The serial communicator 160 is also operable to obtain information from the first post-processing apparatus 2 through the serial communicator 270.

The first post-processing apparatus 2 has a first post-processing apparatus controller 200 that is configured to control the entire first post-processing apparatus 2. The first post-processing apparatus controller 200 may be configured by, for example, a CPU and a program for running the CPU, a ROM for storing programs, and a RAM providing a workspace. The first post-processing apparatus controller 200 performs control over the units of the first post-processing apparatus 2 in response to, for example, control commands from the image forming apparatus controller 100.

The first post-processing apparatus controller 200 is connected with a first feeder 260 and a second feeder 261. The first feeder 260 is a unit that is configured to feed sheets sent from the image forming apparatus 1 for discharge. The second feeder 261 is a unit that branches from the first feeder 260 and is configured to feed the sheets without performing saddle stitching. Selection between the first feeder 260 and the second feeder 261 is performed by the first post-processing apparatus controller 200 according to the post-processing details.

The first post-processing apparatus controller 200 is controllably connected with the creaser 210 through a creaser controller 211. The creaser 210 is configured to crease sheets. The creases may be used for a square back portion of a sheet or for a gutter on a cover in case bookbinding. Providing creases in a square back portion facilitates formation of a square back. Providing a crease for a gutter on a cover facilitates double spread.

The first post-processing apparatus controller 200 is controllably connected with a stacker 220, the folder 230, the binder 240, and the cutter 250.

The stacker 220 is configured to stack a plurality of sheets in preparation for saddle stitching and to feed the sheets.

The folder 230 is configured to perform folding processing on sheets in preparation for saddle stitching.

The binder 240 is configured to perform binding processing on the folded sheets by using, for example, staples.

The first post-processing apparatus controller 200 is controllably connected with the serial communicator 270 and a serial communicator 280. The serial communicator 270 is, as described earlier, configured to perform serial communication with the serial communicator 160 included in the image forming apparatus 1. The serial communicator 270 obtains control commands from the image forming apparatus controller 100 and information from the image forming apparatus 1 for transmission to the first post-processing apparatus controller 200. The first post-processing apparatus controller 200 controls the first post-processing apparatus 2 in response to control commands from the image forming apparatus controller 100.

The serial communicator 280 is configured to perform serial communication with a serial communicator 370 included in the second post-processing apparatus 3. The serial communicator 280 sends information of the first post-processing apparatus 2 to the serial communicator 370, and in response to control commands from the image forming apparatus 1, to the serial communicator 370. Further, information of the second post-processing apparatus 3 is sent through the serial communicator 280 to the first post-processing apparatus controller 200, and through the serial communicator 280, the serial communicator 270, and the serial communicator 160, to the image forming apparatus controller 100.

The second post-processing apparatus 3 has a second post-processing apparatus controller 300 that is configured to control the entire second post-processing apparatus 3. The second post-processing apparatus controller 300 may be configured by, a CPU and a program for running the CPU, a ROM for storing, for example, programs, and a RAM providing a workspace. The second post-processing apparatus controller 300 performs control over the units of the second post-processing apparatus 3 in response to, for example, commands from the image forming apparatus controller 100. It is to be noted that the second post-processing apparatus 3 is, as described above, a post-processing apparatus configured to perform case bookbinding, and the second post-processing apparatus controller 300 corresponds to a post-processing apparatus controller according to embodiments of the present invention.

The second post-processing apparatus controller 300 is controllably connected with a first feeder 310, a second feeder 311, and a third feeder 312. The first feeder 310 is a unit that is configured to feed sheets to the main stage stacker 320, which sheets have been sent from the first post-processing apparatus 2 without being saddle stitched at the first post-processing apparatus 2, so as to subject the sheets to case bookbinding. The second feeder 311 is a unit that is configured to feed sheets without performing case bookbinding for discharge. The third feeder 312 is a unit that is configured to feed the sheets sent from the image forming apparatus 1 as covers. Selection among the first feeder 310, the second feeder 311, and the third feeder 312 is performed by the second post-processing apparatus controller 300 by way of a discharge path selector 309 according to, for example, the post-processing details.

The second post-processing apparatus controller 300 has the main stage stacker 320 and a sub-stage stacker 330 that are configured to stack sheets.

Moreover, the second post-processing apparatus controller 300 is controllably connected with a first discharger 360 and a second discharger 361. Selection between the first discharger 360 and the second discharger 361 as a discharge destination is performed by the discharge path selector 309.

The second post-processing apparatus controller 300 is controllably connected with a paste replenisher 341, a paste application controller 342, and a paste application roller inclination controller 343. The paste replenisher 341, the paste application controller 342, and the paste application roller inclination controller 343 are included in the paste applicator 340 depicted in FIG. 1.

Figure 3:
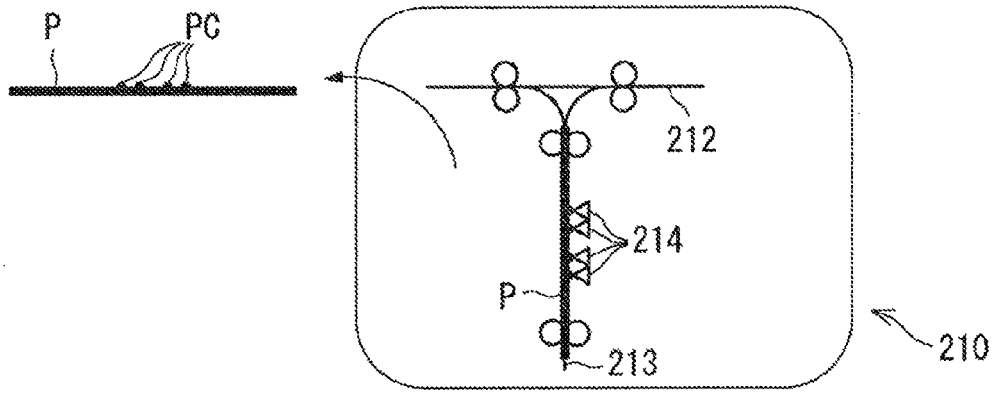
FIG. 3 depicts a structure of a stacker of a first post-process apparatus of the image forming system.

Next, a structure of the creaser 210 in the first post-processing apparatus 2 is described with reference to FIG. 3.

A flipping feed path 213 is juxtaposed to a feed path 212 in the creaser 210, allowing selection between straight feeding for not performing creasing and flipping feeding for performing creasing.

Creasing members 214 that are configured to perform creasing on a fed sheet P are provided at a plurality of locations in the flipping feed path 213. The creasing members 214 are movable in the direction in which the sheets are fed and are operable to form creases PC at appropriate positions on the sheet P. The creasing members 214 are operable in such a manner as to, for example, oppose a creasing projection and a creasing groove toward the front side and the rear side, respectively, of the fed sheet P, and to relatively bring the projection and groove closer to each other to form a crease PC on the sheet P. The sheets having the creases PC formed thereon are conveyed to the downstream side of the feed path 212.

Figure 4:
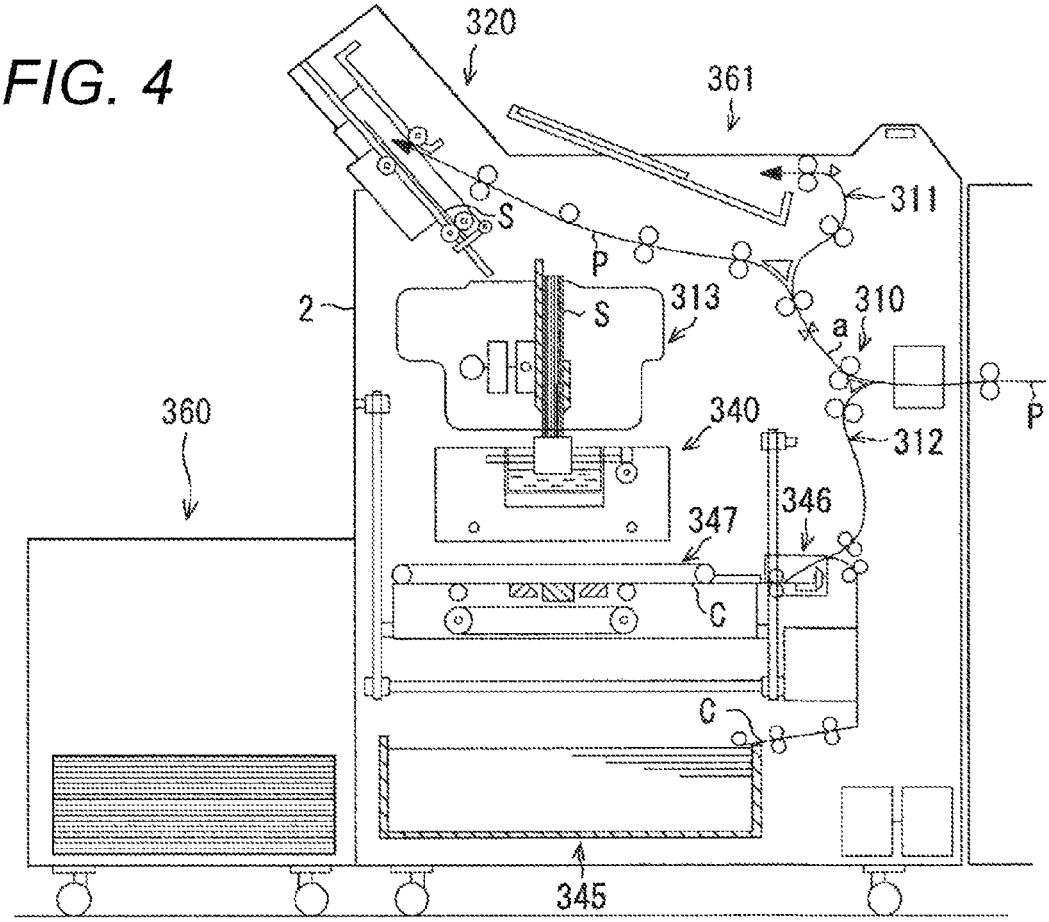
FIG. 4 depicts a structure of a second post-processing apparatus of the image forming system.

Next, the overall structure of the second post-processing apparatus 3 is described with reference to FIG. 4.

The second post-processing apparatus 3 includes, for example, the first feeder 310, the second feeder 311, the first discharger 360, the second discharger 361, a sheet bundle container 313, the main stage stacker 320, the paste applicator 340, a cover supplier 345, a cover cutter 346, and a joiner 347.

The sheets P on which images are formed in the image forming apparatus 1 are fed by the first feeder 310. A plurality of sheets P is collected and stacked at the main stage stacker 320, so as to form a sheet bundle S.

The sheet bundle S is conveyed by a sheet bundle feeder 313 to a predetermined position and is applied with paste at the back of the sheet bundle S by the paste applicator 340.

A cover sheet C that has been supplied from the image forming apparatus 1 or the cover supplier 345 is adhesively bonded to the back of the sheet bundle S applied with paste, and the sheet bundle S is folded along the two edges of the back, such that a booklet S is completed.

Figure 5:
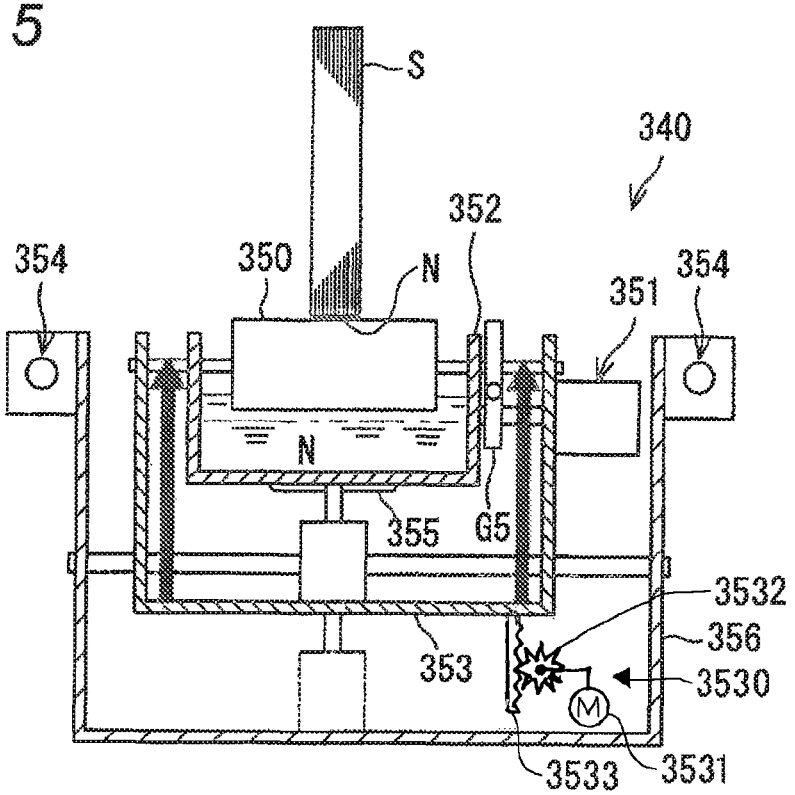
FIG. 5 depicts a front side structure of a paste applicator of the image forming system.

Next, details of the paste applicator 340 are described with reference to FIG. 5.

The paste applicator 340 includes, for example, an application roller 350 which is an application member, a driver 351 that is configured to give a rotational drive to the application roller 350, an adhesive receptacle 352 that contains an adhesive N such as paste, a moving body 353 that supports the adhesive receptacle 352 and is movable from an initial position on the back surface side to an application position on the other end side in the longitudinal direction of the booklet, a casing 356 that holds the moving body 353, a movement driver 354 that is configured to cause the moving body 353 together with the casing 356 to reciprocate, and a heater 355 that is configured to heat the adhesive N contained in the adhesive receptacle 352. The adhesive receptacle 352 corresponds to the paste replenisher 341.

The moving body 353 in the paste applicator 340 is caused to move by the movement driver 354 in a direction parallel to the longitudinal direction of the lower surface of the sheet bundle S being held upright. The moving body 353 and the movement driver 354 correspond to a moving mechanism configured to cause the application member to move according to embodiments of the present invention.

The moving body 353 starts moving from the initial position on the back surface side of the booklet and moves along the movement driver 354, and stops at a predetermined position on the booklet S, where a reverse drive is given, to return to the initial position.

The moving body 353 is movable upward and downward with respect to the casing 356. It is to be noted here that, optionally, the inclination of the paste application roller may be variable. This type of adhesive receptacle 352 is expensive, but the adhesive is applicable with the application roller tilted toward one side, thus allowing for still more precise application control. This optional adhesive receptacle 352 is automatically recognized when mounted. When this adhesive receptacle 352 is mounted, paste is applicable with the roller tilted when the gutter of the cover is provided at one side, or tilted toward the side with a deeper gutter when the cover has different depths (lengths) of gutters.

Specifically, the adjustment of the inclination angle is achieved by a driving unit (not shown) in the direction of the back width of the book bundle in conjunction with the adhesive receptacle 352 and the application roller 350. This inclination allows adjustment of the amounts of paste overflow at two sides of the booklet when the application roller 350 touches the back across the book bundle. The mechanism for performing adjustment of the inclination angle configures an application member inclining mechanism 3530 according to embodiments of the present invention. The application member inclining mechanism 3530 may be configured by, for example, an appropriate drive motor 3531 and a drive force transmission member 3532. For example, the inclination angle of the moving body 353 is adjustable by giving a push by a pushup stick 3533 at one end side of the moving body 353 in the back width direction. The angular inclination of the moving body 353 is performed under control of the second post-processing apparatus controller 300 through the paste application roller inclination controller 343. The inclination angle is adjusted based on control commands from the image forming apparatus controller 100.

Figure 6:
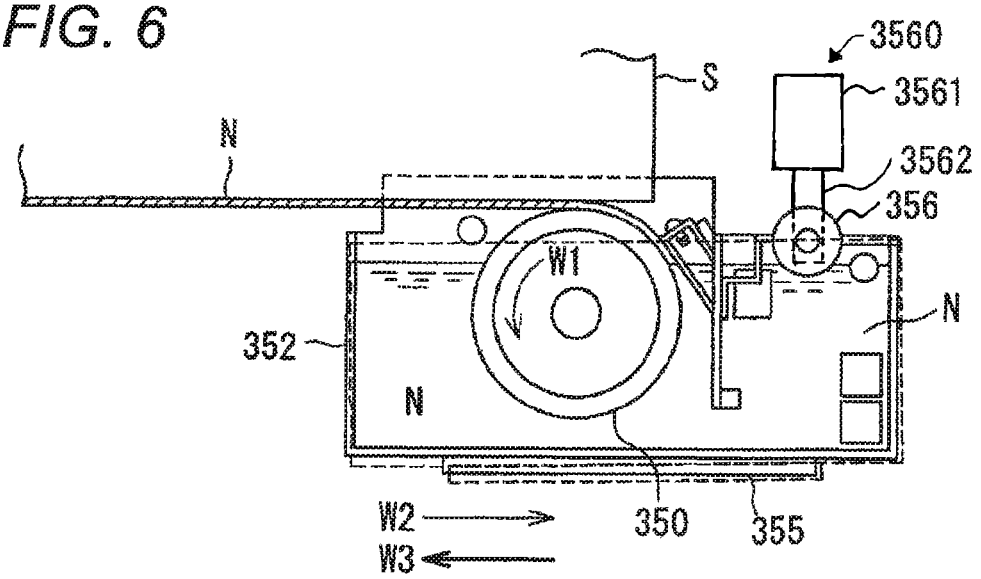
FIG. 6 depicts a lateral side structure of the paste applicator of the image forming system.

Next, a structure in the vicinity of the adhesive receptacle 352 is described with reference to FIG. 6.

A portion of the application roller 350 is soaked in the adhesive N in the adhesive receptacle 352. Further, a smoothing roller 356 of a smaller diameter is rotationally positioned in the adhesive receptacle 352. The smoothing roller 356 has an upper surface that slightly protrudes from the upper surface of the application roller 350 and has a portion that is soaked in the adhesive N. The smoothing roller 356 rotates in contact with a portion of the paste applied to the back surface of the booklet S in the direction of movement in which the smoothing roller 356 touches the booklet S that has been coated with the paste by the application roller 350; in this manner, the smoothing roller 356 fulfills a function of adjusting the thickness of the paste thus applied.

The smoothing roller 356 is operable to relatively change the vertical position thereof with respect to the back surface of the booklet S so as to adjust the distance from the back surface. The change in vertical position provides change in distance from the back surface of the booklet S that has been coated with the paste, such that the amount of application of paste is adjusted. For example, a larger distance from the booklet S reduces the amount to be smoothed out, hence increasing the amount of application of the paste. The smoothing roller 356 corresponds to a smoothing member according to embodiments of the present invention.

The adjustment of the vertical position of the smoothing roller 356 is achieved by a smoothing member distance adjusting mechanism 3560 that is configured by, for example, an appropriate driver 3561 and a drive force transmitting mechanism 3562.

Further, the rotational speed W1 of the application roller 350 when being rotated by the driver 351 is adjustable. Increase in rotational speed W1 allows increase in amount of paste to be applied to the back surface of the booklet S.

The adhesive receptacle 352 is caused to move in the longitudinal direction of the booklet in association with the moving body 353 by the movement driver 354, and the moving speed W2 at this time is adjustable. Decrease in moving speed allows increase in amount of paste to be applied to the booklet S.

In applying paste, the moving body 353 is reciprocated in the longitudinal direction of the booklet S, and the number of reciprocatory movement W3 is increasable. Increase in number of reciprocatory movement W3 allows increase in amount of paste to be applied to the booklet S.

The above-described adjustment of the vertical position of the smoothing roller 356, the rotational speed of the application roller, the moving speed of the adhesive receptacle 352, and the number of movement of the adhesive receptacle 352 is performed under control of the second post-processing apparatus controller 300. The adjustment is also performed based on control commands from the image forming apparatus controller 100.

Figure 7:
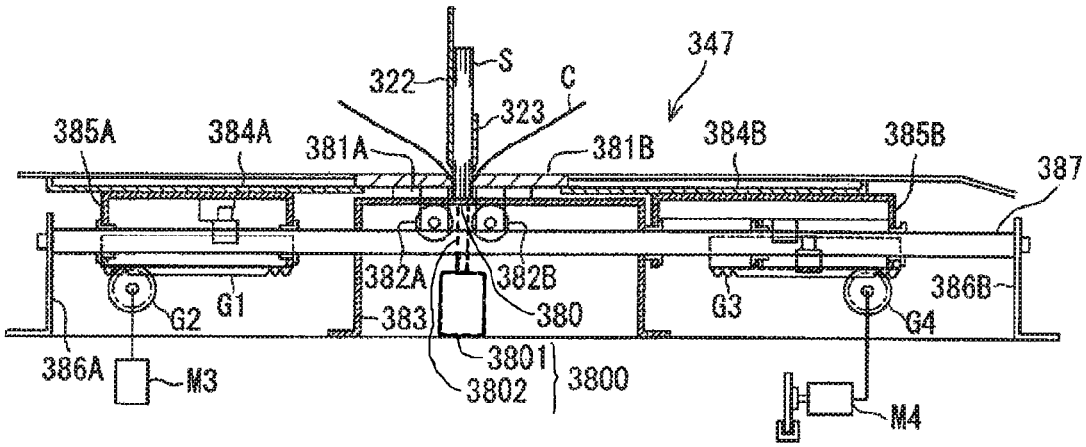
FIG. 7 depicts a structure of a joiner of the image forming system.

Next, a structure of the joiner 347 is described with reference to FIG. 7.

The joiner 347 brings the cover C into abutment with the back of the sheet bundle S with the adhesive N coated thereon and adhesively bonds the cover C thereto. The joiner 347 uses a pair of forming members 381A and 381B to fold the cover C and form a square back.

When the joiner 347 ascends, the cover C is joined to the sheet bundle S by a pressurization member 380. The position where pressurization be stopped is fixed for the pressurization member 380 such that the pressurization member has a predetermined distance from the back surface of the booklet S.

A roller 382A is rotatably supported at a lower portion in the vicinity of the leading end of the forming member 381A that is positioned at the left-hand side in the figure with respect to the sheet bundle S. The roller 382A is movable horizontally while being in abutment with a flat surface portion of a support member 383 that is fixedly positioned on the main body of the apparatus.

A connecting panel 384A that is fixedly positioned in the vicinity of the rear end of the forming member 381A is connected to a movable frame body 385A. The movable frame body 385A is slidable along a guide bar 387 with a bearing interposed therebetween. The guide bar 387 is supported horizontally by support members 386A and 386B.

A rack gear G1 is disposed on a bottom portion of the movable frame body 385A. The rack gear G1 meshes with a pinion gear G2 that is supported on the main body of the apparatus. The pinion gear G2 is rotated by a motor M3, causes the rack gear G1 to move horizontally, and causes the movable frame body 385A that is integral with the rack gear G1, the connecting panel 384A, and the forming member 381A to move horizontally.

A roller 382B is rotatably supported at a lower portion in the vicinity of the leading end of a forming member 381B that is positioned at the right-hand side in the figure of the sheet bundle S. The rollers 382A and 382B are movable horizontally in abutment with the flat surface portion of the support member 383 that is fixedly positioned on the main body of the apparatus.

A connecting panel 384B that is fixedly positioned in the vicinity of the rear end of the forming member 381B is connected to a movable frame body 385B. The movable frame body 385B is slidable along the guide bar 387 with a bearing interposed therebetween. The guide bar 387 is supported horizontally by the support members 386A and 386B.

A rack gear G3 is disposed on a bottom portion of the movable frame body 385B. The rack gear G3 meshes with a pinion gear G4 that is supported on the main body of the apparatus. The pinion gear G4 is rotated by a motor M4, causes the rack gear G3 to move horizontally, and causes the movable frame body 385B that is integral with the rack gear G3, the connecting panel 384B, and the forming member 381B to move horizontally.

The joiner 347 has, for example, the rollers 382A and 382B that are configured to receive and convey the cover C supplied from the image forming apparatus 1 or the cover supplier 345 so as to stop the cover C at a predetermined position, and the pressurization member 380 that is configured to press the cover C onto the surface of a sheet bundle over which the adhesive is coated.

The joiner 347 is ascendable and descendable by way of an elevating belt (not shown).

When the joiner 347 stops at a lowered position for introducing a cover C, the cover C is registered and fed to the cover cutter 346 to be cut at a predetermined position.

The joiner 347 moves to an upper position for joining, and at this raised position, a central portion of the cover C that is placed on the pressurization member 380 pressingly contacts the surface of a sheet bundle S over which the adhesive is coated, and the cover C is bonded thereto.

It is to be noted that the distance between the pressurization member 380 and the back surface of the sheet bundle is adjusted in pressing the sheet bundle onto the cover, such that the overflow amount toward the side surfaces of the sheet bundle is adjusted. Decreasing the distance increases the overflow amount.

Further, the pressurization member 380 normally pressingly contacts the back surface of the sheet bundle S with the upper surface of the pressurization member in parallel with the back surface; however, the pressurization member 380 may also be configured adjustable into an inclined condition with respect to the back surface of the sheet bundle. The pressurization member 380 may be inclined, so as to differentiate the overflow amounts to the two sides of the sheet bundle. For example, in case where the gutters of the cover on the two sides have depths different from each other, the overflow amounts to the two sides may be adjusted into amounts different from each other, so as to compatibly achieve an even more pleasant appearance and stronger durability.

The overflow amounts are also adjustable with respect to the gutters of the cover on the two sides by using a pressurization member made of materials that are divided in the direction of the back surface, and by differentiating the position of each material at which the pressing contact be completed.

The positional change of inclination of the above-described pressurization member 380 and the adjustment of the positions at which the divided pressurization members stop pressurization are implemented as a back width direction stopping position changing mechanism 3800 by using an appropriate driver 3801 and a drive force transmission member 3802.

Next, a cover folding process is described in detail with reference to FIGS. 8A to 8E.

As depicted in the right-hand figures of FIGS. 8A to 8E, the joiner 347 uses the pressurization member 380 to move the cover C toward the back surface of the booklet S over which paste is coated. Changing the heightwise position of the cover allows adjustment of the overflow amount of paste toward side portions of the booklet S.

The cover folding process is performed on the booklet S with a cover bonded by the pair of laterally symmetrical forming members 381A and 382B.

In the cover folding process, the pressurization member 380 is brought into pressing contact with the cover C from the front side toward the booklet side, so as to bond the booklet S to the cover C with a predetermined distance kept between the booklet S and the cover C (FIG. 8A). At this time, paste is appropriately made to overflow onto the side portions of the booklet S.

The forming members 381A and 381B are movable closer and away with respect to the sheet bundle S in the thickwise direction (FIGS. 8B and 8C). The forming members 381A and 381B fold the cover C along the side edges of the surface of the sheet bundle S over which the adhesive is coated, and bring the front cover and the rear cover on the front surface and the rear surface of the sheet bundle S, respectively (FIG. 8D).

After the folding process of the cover C is finished, the forming members 381A and 381B are evacuated from the booklet S (FIG. 8E), and the joiner 347 is given a descending drive to be lowered by a predetermined distance, so as to be evacuated and stopped. Then, the booklet is discharged to the first discharger 360.

Figure 9A:
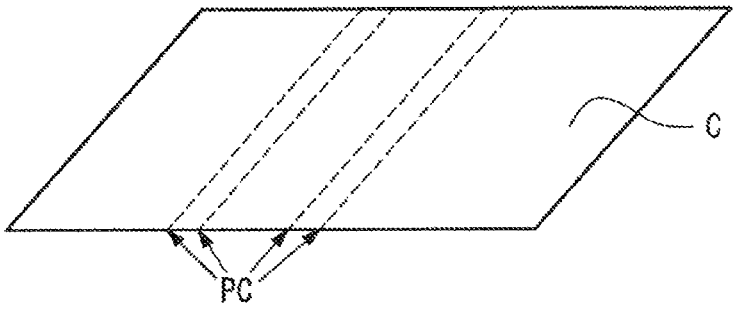
FIGS. 9A to 9C depict the outline of case bookbinding with the image forming system.
Figure 9B:
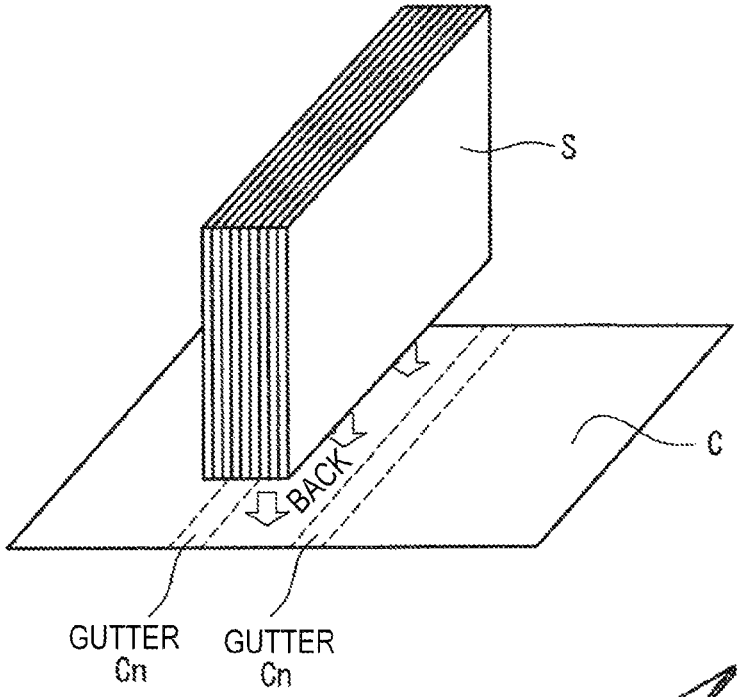
Figure 9C:
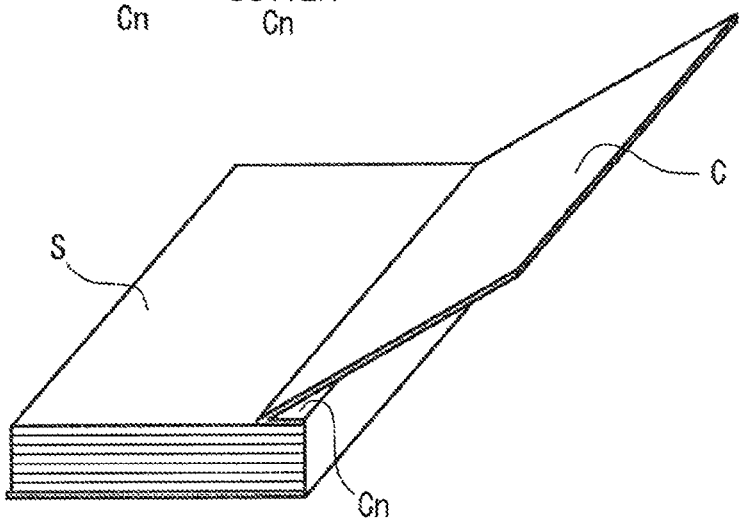

FIGS. 9A to 9C depict a relationship between a booklet S and a cover C to be subjected to case bookbinding. FIG. 9A depicts a cover C to be used for joining. This cover C has creases PC, and cover gutters Cn are provided between the creases PC along the square back and the creases PC on the outer side. FIG. 9B depicts a positional relationship of the cover C with respect to the booklet S in joining.

FIG. 9C depicts a book completed after joining. The booklet S and the cover C are joined at the back surface of the booklet S and the cover gutters Cn and is finished with stronger adhesion and a pleasant appearance.

Figure 10:
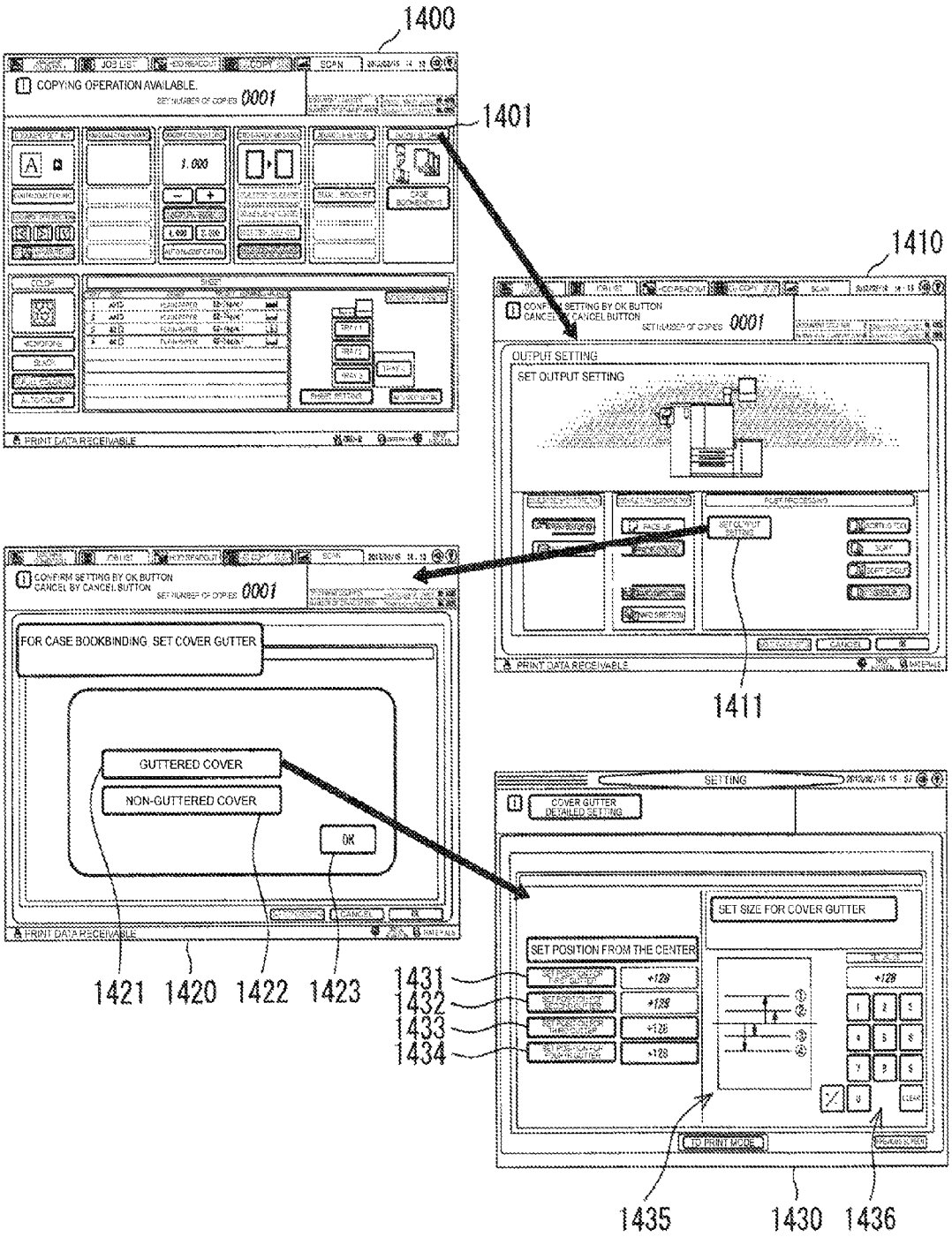
FIG. 10 depicts screens displaying cover gutter settings in case bookbinding with the image forming system.

Next, setting screens for case bookbinding is described with reference to FIG. 10.

A setting screen 1400 shows a main menu that is operably displayed on the operation display 140 and enables various settings. An output setting button 1401 is used to perform output setting including post-processing. The output setting button 1401 is pressed, such that an output setting screen 1410 is displayed on the operation display 140.

A case bookbinding button 1411 that is used to perform setting relating to case bookbinding is pressably displayed in the output setting screen 1410. When the case bookbinding button 1411 is pressed, a gutter setting screen 1420 is displayed on the operation display 140. The gutter setting screen 1420 is used to perform setting of cover gutters in connection with case bookbinding.

A guttered cover button 1421 and a non-guttered cover button 1422 are pressably displayed in the cover gutter setting screen 1420. When the non-guttered cover button 1422 is pressed and an OK button 1423 is further pushed down, non-guttered cover setting is confirmed. When the guttered cover button 1421 is pushed down, a cover gutter detailed setting screen 1430 is displayed in the operation display 140. The cover gutter detailed setting screen 1430 corresponds to the guttered cover/non-guttered cover mode setting selector 144.

The position to be provided with each gutter is settable with respect to the center position in the back width in the cover gutter detailed setting screen 1430, and setting buttons 1431 to 1434 are provided for each position for a gutter. The summaries of the gutter positions are displayed in a gutter position image 1435. To set the gutter positions, any of the setting buttons 1431 to 1434 may be selected, and then specific numerical values may be inputted with a numeric keypad 1436.

When a case bookbinding job is initiated on completion of the setting, a book body for one copy of booklet is first printed, and then a cover is printed at the end of the first copy printing. The creased cover is bound by the case bookbinder, and the above operation is repetitively performed for the second copy and onward. It is to be noted that information such as "guttered" is transmitted as sheet information from the image forming apparatus 1 to each post-processor through the serial communicators in the block diagram.

In this embodiment, four creases are divided into portions referred to as a "back portion" and a "gutter" of a booklet. The creases in the gutter portions are provided to facilitate double spread. Hence, the presence and absence of a cover gutter is determined from this setting.

In this embodiment, however, while the gutters are set according to the positions to be provided with creases, a cover gutter is settable even where creases are not formed, and the range of the cover gutter may also be settable. In this case, whether a crease is formed or not is irrelevant.

Figure 11:
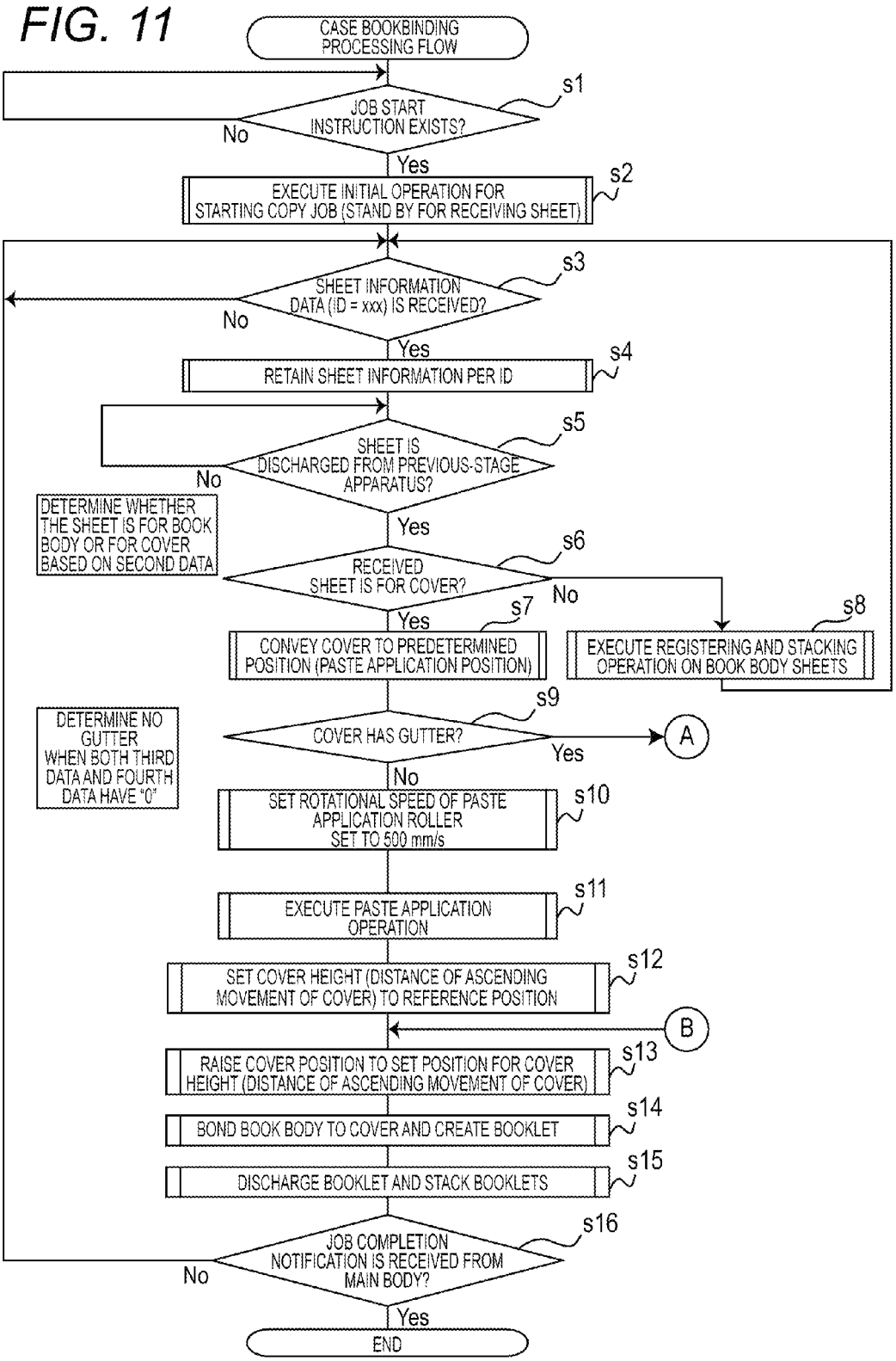
FIG. 11 is a flowchart depicting part of a procedure for case bookbinding with the image forming system.

Next, procedural processes of case bookbinding are described with reference to the flowcharts in FIGS. 11 and 12. It is to be noted that the following procedure is executed based on control commands from the image forming apparatus controller 100, and the units of the post-processing apparatuses are controlled by the first post-processing apparatus controller 200 and the second post-processing apparatus controller 300.

First, determination is made as to whether a job start instruction exists (step s1). In case where the start instruction does not exist (step s1; No), the instruction is awaited, and in case where the start instruction exists (step s1; Yes), an initial operation for copying operation is executed (step s2). The units stand by for receiving sheets (step s2).

Next, determination is made whether sheet information data (identification (ID) details) has been received (step s3). In case where the data has not been received, reception is awaited (step s3; No). The sheet information data contains, as shown in Table 1, an ID number, information on whether the sheet is for a book body or for a cover, information on the depth of a cover gutter (unit: cm), information on the cover left-hand gutter (unit: cm), and data for adjusting the height of the cover (cover height) (unit: ±mm), per sheet. It is to be noted that the data for adjusting the cover height may be absent, or the data may indicate the depth of one gutter without separate data for the right and left of the cover.

The sheet information is sent from the image forming apparatus 1 to the first post-processing apparatus 2 and the second post-processing apparatus 3. Control is performed over the first post-processing apparatus 2 and the second post-processing apparatus 3 based on this information at the first post-processing apparatus controller 200 and the second post-processing apparatus controller 300.

TABLE 1

| | |
|---|---|
| ID NUMBER (ID = xxx) | (1) DATA |
| BOOK BODY OR COVER INFORMATION | (2) DATA |
| COVER RIGHT-HAND GUTTER DEPTH INFORMATION (UNIT: cm) | (3) DATA |
| COVER LEFT-HAND GUTTER DEPTH INFORMATION (UNIT: cm) | (4) DATA |
| COVER HEIGHT ADJUSTMENT DATA (UNIT: ± mm) | (5) DATA |

When it is determined that the sheet information data (ID details) has been received (step s3; Yes) in the determination on the reception of data, the sheet information data per ID is retained on, for example, a memory of the second post-processing apparatus controller 300 (step s4).

Next, determination is made whether a sheet has been discharged from an apparatus at the previous stage (step s5). In case where no discharge is recognized (step s5; No), the sheet is awaited. In case where a sheet has been discharged from the apparatus at the previous stage (step s5; Yes), determination is made whether the sheet received is a cover based on the second information in the sheet information (step s6). In case where the sheet received is a cover (step s6; Yes), the cover is conveyed to a predetermined position for application of paste (step s7). In case where the sheet received is not a cover (step s6; No), sheets for a book body are registered and stacked (step s8), and the process returns to step s3.

After step s7 where the cover is conveyed to the predetermined position, determination is made whether the cover has a gutter based on the third and fourth information in the sheet information (step s9). In case where the cover has a gutter (step s9; Yes), the processes depicted in FIG. 12 (step s20 and onward) are executed, and the process moves on to step s13 on completion. It is determinable that the cover does not have a gutter if the data of the third and fourth information both has a value of 0. In case where the cover does not have a gutter (step s9; No), the rotational speed of the paste application roller is set to a reference value of 500 mm/s (step s10), and paste application operation by the paste applicator 340 is performed (step s11). The cover height (the distance of ascending movement of the cover) is set to a reference position (step s12), and raising of the position at which the cover is placed (cover position) is performed with reference to the position set for the cover height (the distance of ascending movement of the cover) (step s13).

Next, the book body is bonded to the cover to finish creating a booklet (step s14), and the booklet is discharged, so as to stack the booklets (step s15). Subsequently, determination is made whether notification has been received from the image forming apparatus 1 that the job has been completed (step s16). In case where the notification of completion has been received (step s16; Yes), the processing is terminated. In case where the job has not been completed (step s16; No), the process returns to step s3.

Figure 12:
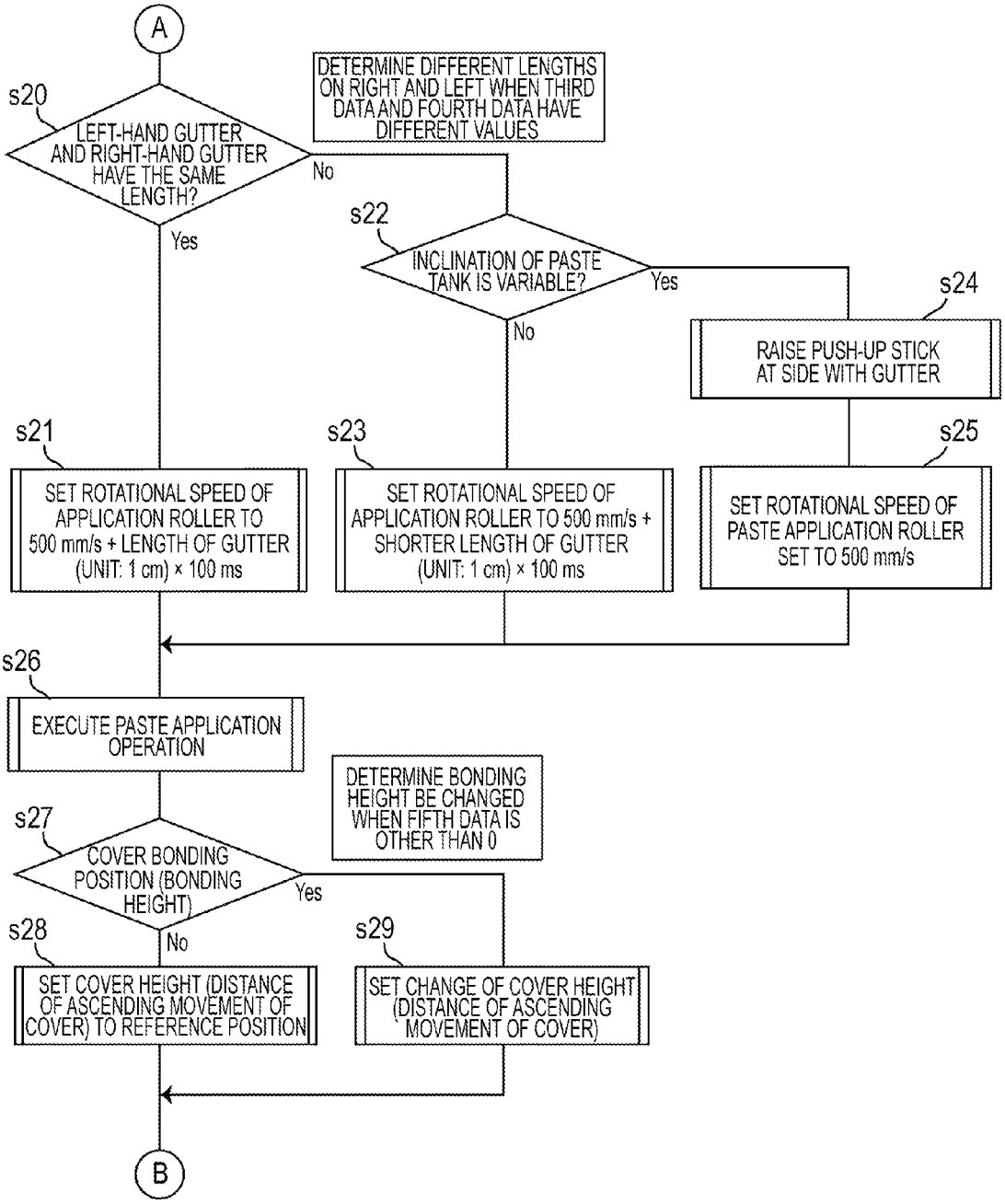
FIG. 12 is a flowchart depicting part of the procedure for case bookbinding with the image forming system.

Next, description is given of a process to be executed in case of a guttered cover with reference to the flowchart in FIG. 12.

Determination is made whether the cover gutters have the same length on the right and left based on the third and fourth information in the sheet information (step s20). In determining whether the lengths are the same on the right and left, it is decided that the lengths are different on the right and left in case where the third information and the fourth information in the sheet information have different data values.

In case where the gutters have the same length on the right and left (step s20; Yes), the rotational speed of the application roller is set to a reference value of 500 mm/s+the length of the gutters (unit: 1 cm)*100 mm/s. In other words, the rotational speed of the application roller is increased by 100 mm/s for an increase in depth of the gutters by 1 cm. If the depth of the gutters is 2 cm, side glue control is performed with the rotational speed set to 500 mm/s+100 mm/s*2=700 mm/s.

In case where the depths of the gutters are different on the right and left (step s20; No), determination is made whether the inclination of the paste tank (the adhesive receptacle) is variable (step s22). In case where the inclination of the paste tank is not variable (step s22; No), side glue control is performed with the rotational speed of the application roller set to 500 mm/s+the shorter depth of the gutter (unit: 1 cm)*100 mm/s. The overflow amount is set with reference to the shorter depth of the gutter, thus obviating worsening of the appearance with the overflow being excessive at the side with the shorter gutter.

In case where the length of the shorter gutter is 0, it may be decided that the gutter is provided on one side; moreover, in case where the inclination of the paste tank is unchangeable, the amount of application may be set to the same value as the reference amount for a normal (non-guttered) amount of application, so as to bring the overflow amount the same as in the non-guttered cover setting. It is to be noted that in case where the cover heightwise position is changed, the overflow amount is going to be different from that in the non-guttered cover setting.

It is to be noted that the inclination of the paste tank is also determinable by retaining a control amount. For example, information on the presence of absence of an inclination is connected to a port of the CPU, and the control software may read the information at the port to distinguish whether the tank is inclinable. In setting an inclinable tank, for example, a dual in-line package switch (DipSW) is desirably set, such that the inclination is recognizable with a hardware change with respect to the information of the CPU.

In case where the inclination of the paste tank is variable (step s23; Yes), side glue control is performed with the pushup stick that is disposed at the side with a gutter or the side with a deeper gutter being raised so as to differentiate the amounts of paste to be applied to each side of the back width. This allows the paste to overflow in a larger overflow amount toward the side portion of the booklet on the upwardly inclined side. Next, the rotational speed of the paste application roller is set to the reference value of 500 mm/s (step s25). The rotational speed at this time may be higher than the reference value.

After steps s21, s23, and s25, paste application operation is performed (step s26). Subsequently, determination is made whether setting of the cover reference position (bonding position) be made based on the fifth information in the sheet information (step s27). In case where the fifth information has data of 0, the reference position is set, whereas in case where the fifth information has a numerical value that is other than 0 and is ±0, the height at which bonding is performed (bonding height) is set. It is to be noted that in case of an apparatus in which the cover reference position is unchangeable, the process proceeds to procedure A.

In case where the cover bonding position is not to be changed (step s27; No), the cover height (the distance of ascending movement of the cover) is set to the reference position, and the process returns to step s13 according to procedure A.

In case where the cover bonding position is to be changed (step s27; Yes), the setting of the cover height (the distance of ascending movement of the cover) is changed, and the process returns to step s13 according to procedure B.

Figure 13:
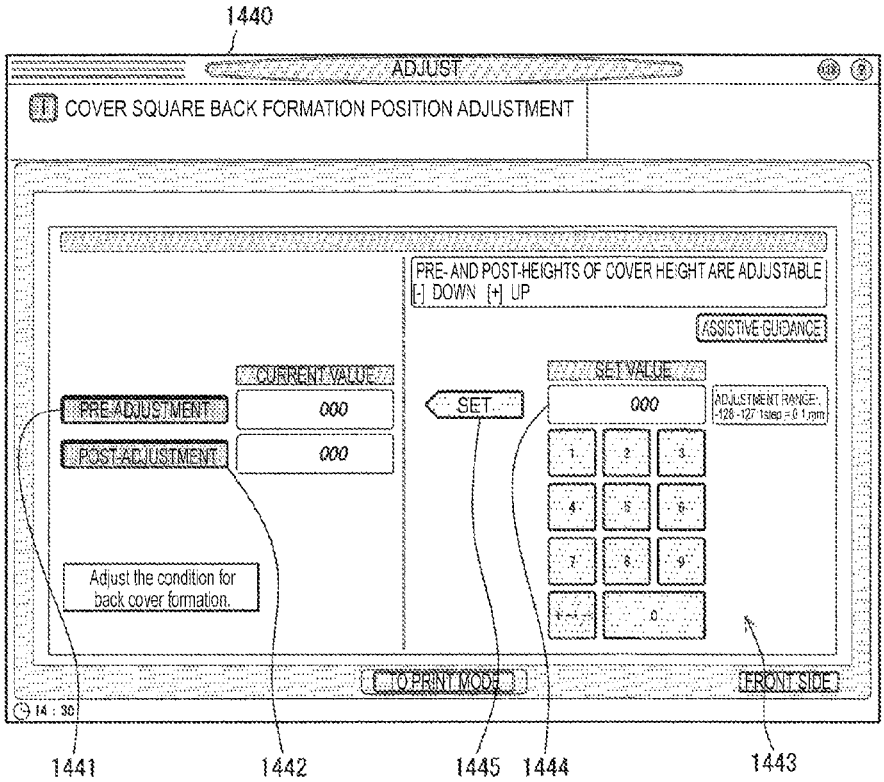
FIG. 13 depicts a screen for adjusting a heightwise position of a cover with the image forming system.
Figure 14:
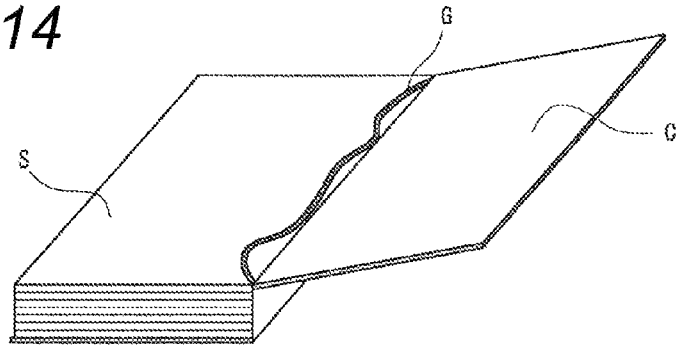
FIG. 14 depicts a situation that is likely to occur in case bookbinding.

FIG. 13 depicts a screen 1440 for adjusting the position in a cover at which a square back is formed (cover square back formation position adjustment screen 1440), which screen is displayed in the operation display 140, to change the cover bonding position. This adjustment is settable as one setting item for case bookbinding.

The cover square back formation position adjustment screen 1440 allows pre-adjustment and post-adjustment with respect to a reference position. Setting for raising the cover position (−setting) may be made upon pressing a forward adjustment button 1441, and setting for lowering the cover position (+setting) may be made upon pressing a backward adjustment button 1442. The value may be set by a unit of 0.1 mm with a numeric keypad 1443. The input value is displayed in an input value display column 1444, and the cover position is decided to the numerical value displayed in the display column 1444 by pressing a set button 1444. The fifth information in the sheet information is hence set on the basis of the data of the cover height thus decided.

It is to be noted that, in the above embodiment, description was given of increasing of the amount of application of paste by increasing the rotational speed of the application roller; however, as depicted in the above-described flowchart, the amount of application of paste is changeable independently or together with change in rotational speed of the application roller by changing the cover height.

Further, the amount of application of paste may be increased by increasing the number of movement of the adhesive receptacle (the number of reciprocatory movement for paste application), and/or by adjusting the ascending and descending distance of the smoothing roller. Moreover, the amount of application of paste may be increased by decreasing the moving speed of the adhesive receptacle. Side glue control may be performed for a guttered cover by adopting at least one or more of these control methods.

While in the above embodiment, description is made in such a manner that creasing is performed at the saddle stitcher and a gutter is then formed, creasing may be skipped. In case where the user selects the "guttered cover mode," it is also assumed that the amount of paste is increased for application without actually creasing the sheet.

Even in case where the creaser is not provided, it is also conceivable that the booklet created is bent by hand, or alternatively, a gutter is created in a later process by using a tool. Since selection of the "guttered cover mode" represents the user's intention to increase the amount of application of paste, control may be performed including increasing of the amount of application of paste, even though a crease and a gutter are not actually formed.

While description is given of the present invention based on the above embodiment, appropriate modifications are possible without departing from the scope of the present invention.

Although the present invention has been described and illustrated in detail, it is clearly understood that the same is by way of illustrated and example only and is not to be taken by way of limitation, the scope of the present invention being interpreted by terms of the appended claims.

What is claimed is:

1. A post-processing apparatus configured to perform post-processing on a sheet having an image formed thereon, the post-processing at least including case bookbinding by using paste, and the apparatus comprising:

a paste applicator having a paste application member and configured to supply paste to coat a back of a sheet bundle with the paste;

a pressurization member configured to press a cover onto the back of the sheet bundle with the paste coated thereon; and a controller configured to receive information relating to a cover gutter setting and to perform control over the paste applicator and the pressurization member, the controller being configured to cause, in a guttered cover setting, the paste to overflow in a larger amount from the back of the sheet bundle toward a gutter than an amount of overflow in a non-guttered cover setting based on the information relating to the cover gutter setting, wherein the information relating to the cover gutter setting contains information on a depth of the gutter, and wherein the controller is configured to set the larger amount according to the depth of the gutter.

2. The post-processing apparatus according to claim 1, wherein the controller is configured to increase an amount of application of the paste to be applied to the sheet bundle by way of the paste applicator in the guttered cover setting.

3. The post-processing apparatus according to claim 1, wherein the controller is configured to increase an amount of the paste to move toward the gutter by way of the pressurization member, the paste being placed between the back of the sheet bundle and the cover, in the guttered cover setting.

4. The post-processing apparatus according to claim 1, wherein:

the information relating to the cover gutter setting further contains information relating to whether the gutter is set on each of two sides or on one side of the sheet bundle, and the controller is configured to, where the gutters are set on the two sides of the sheet bundle, set different amounts of overflow with respect to each gutter.

5. The post-processing apparatus according to claim 4, wherein the controller is configured to, where the gutters on the two sides have different depths, set the amounts of overflow with respect to the gutters on the two sides according to the depth of each gutter.

6. The post-processing apparatus according to claim 4, wherein the controller is configured to, where the gutters on the two sides have different depths, decide the amounts of overflow at the gutters on the two sides with reference to the gutter of a shallower depth.

7. The post-processing apparatus according to claim 4, wherein:

the paste applicator has an application member inclining mechanism configured to change an inclination angle of the paste applicator in a direction of a back width with respect to the back in performing the application, and the controller is configured to adjust the inclination angle of the application member inclining mechanism to adjust the amounts of overflow with respect to the gutters on the two sides of the sheet bundle, or to adjust the amount of overflow toward the gutter where the gutter is provided on one side.

8. The post-processing apparatus according to claim 4, wherein:

the apparatus includes a back width direction stopping position changing mechanism configured to change a position at which the pressurization member is stopped in a direction of a back width with respect to the back of the sheet bundle, and the controller is configured to, in the guttered cover setting, adjust the back width direction stopping position changing mechanism to perform control for adjusting the amounts of overflow to the gutters on the two sides of the sheet bundle or the amount of overflow toward the gutter where the gutter is provided on one side.

9. The post-processing apparatus according to claim 1, wherein the controller is configured to, where the gutter is provided on one side of the sheet bundle, skip an operation of increasing the amount of overflow of the paste from the back of the sheet bundle toward the gutter as compared to the amount of overflow in the non-guttered cover setting.

10. The post-processing apparatus according to claim 1, wherein the controller is configured to increase a drive amount for supplying the paste for the paste application member as compared to a drive amount in the case of a non-guttered cover so as to increase the amount of application of the paste to the back.

11. The post-processing apparatus according to claim 1, wherein:

the paste applicator includes a moving mechanism wherein at least the paste application member is configured to relatively move in a lengthwise direction of the back of the sheet bundle to perform application of the paste, and the controller is configured to, in the guttered cover setting, increase the amount of application of the paste to the back by increasing a number of movements or decreasing a moving speed of the moving mechanism in the lengthwise direction or both.

12. The post-processing apparatus according to claim 1, wherein:

the paste applicator includes a smoothing member and a smoothing member distance adjusting mechanism, the smoothing member being configured to approach the back applied with the paste to smooth out the paste applied, the smoothing member distance adjusting mechanism being configured to adjust a distance of the smoothing member to the back, and the controller is configured to, in the guttered cover setting, adjust an amount of distance adjustment by the smoothing member distance adjusting mechanism to increase the amount of application of the paste to the back.

13. The post-processing apparatus according to claim 1, wherein the controller is configured to, in the guttered cover setting, change a position at which the pressurization member stops pressurization with respect to the back from a position at which the pressurization is stopped in the non-guttered cover setting to perform control for adjustment of the amount of overflow to the gutter.

14. The post-processing apparatus according to claim 1, further comprising a creaser configured to crease the sheet prior to case bookbinding.

15. The post-processing apparatus according to claim 14, wherein the creaser is configured to crease the sheet at least in line with the gutter.

16. The post-processing apparatus according to claim 14, wherein:

the information relating to the cover gutter setting contains information as to whether a crease other than a crease for a square back of the sheet bundle is provided, and the controller is configured to determine the presence of the guttered cover setting based on information about the presence of the crease other than the crease for the square back of the sheet bundle, and to determine the absence of the guttered cover setting based on information about the absence of the crease other than the crease for the square back of the sheet bundle.

17. An image forming system comprising:

an image forming apparatus configured to form an image on a sheet; and the post-processing apparatus of claim 1.

18. A method of post-processing for performing case bookbinding by using paste, wherein a guttered cover setting or a non-guttered cover setting is selectable, the method comprising:

setting an increased amount of overflow of the paste from a back of a sheet bundle toward a gutter in the guttered cover setting as compared to the amount of overflow for a non-guttered cover;

applying the paste to the back of the sheet bundle based on received information relating to the guttered cover setting; and bringing a cover into pressing contact with the back upon application of the paste to make the paste overflow toward the gutter, such that case bookbinding of the sheet bundle with the cover is performed by using the back of the sheet bundle and the gutter, wherein the information relating to the guttered cover setting contains information on a depth of the gutter, and wherein the increased amount of overflow is set according to the depth of the gutter.

* * * * *